US006986646B2

(12) United States Patent
Bettenhausen et al.

(10) Patent No.: US 6,986,646 B2
(45) Date of Patent: Jan. 17, 2006

(54) ELECTRONIC TRIM FOR A VARIABLE DELIVERY PUMP IN A HYDRAULIC SYSTEM FOR AN ENGINE

(75) Inventors: Craig A. Bettenhausen, Athens, GA (US); Bryan E. Nelson, Lacon, IL (US); Larry R. Mitzelfelt, Jr., Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 133 days.

(21) Appl. No.: 10/121,822

(22) Filed: Apr. 12, 2002

(65) Prior Publication Data

US 2003/0194326 A1 Oct. 16, 2003

(51) Int. Cl.
*F04B 49/00* (2006.01)
*F02M 41/00* (2006.01)

(52) U.S. Cl. ..... 417/53; 417/44.1; 417/280; 123/456; 73/119 A

(58) Field of Classification Search ..... 417/53, 417/15, 34, 42, 44.1, 279, 280, 300; 123/456, 123/446, 447, 468, 469, 470, 472, 478, 480; 73/119 A
See application file for complete search history.

(56) References Cited

U.S. PATENT DOCUMENTS 3,347,093 A * 10/1967 Hauk ..... 73/168
3,577,776 A * 5/1971 Brown, Jr. ..... 73/119 A
3,779,457 A * 12/1973 Cornyn, Jr. ..... 235/151.3
3,839,627 A * 10/1974 Grant et al. ..... 235/151.3
4,347,818 A * 9/1982 Wysong ..... 123/369
4,463,729 A * 8/1984 Bullis et al. ..... 123/478
4,487,181 A 12/1984 Moore et al.
4,790,277 A 12/1988 Schechter
5,297,523 A 3/1994 Hafner et al.
5,357,912 A 10/1994 Barnes et al.
5,603,609 A 2/1997 Kadlicko
5,615,801 A * 4/1997 Schroeder et al. ..... 222/51
5,634,448 A 6/1997 Shinogle et al.
5,839,420 A 11/1998 Thomas
6,033,187 A * 3/2000 Addie ..... 417/18
6,035,828 A 3/2000 Anderson et al.
6,112,720 A 9/2000 Matta
6,357,420 B1 * 3/2002 Matta ..... 123/446
6,454,540 B1 * 9/2002 Terefinko et al. ..... 417/46
6,493,627 B1 * 12/2002 Gallagher et al. ..... 701/104
6,502,551 B2 * 1/2003 Antonioli et al. ..... 123/456
6,522,964 B1 * 2/2003 Miki et al. ..... 701/50
6,671,611 B1 * 12/2003 Peltier ..... 701/104

OTHER PUBLICATIONS

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4-5, 2000, Vienna, Austria.

* cited by examiner

*Primary Examiner*—Charles G. Freay
(74) *Attorney, Agent, or Firm*—Liell & McNeil

(57) ABSTRACT

Electronically controlled variable delivery pumps produce output based upon a control signal generated by an electronic control module. The electronic control module includes programming that acknowledges that each pump may have performance characteristics that deviate from a hypothetical nominal pump. Actual pump performance characteristics are then programmed into the electronic control module so that pump control signals are customized or electronically trimmed to suit the performance characteristics of that individual pump. The performance characteristics of the individual pump are gained through testing. The electronic pump trimming strategy of the present invention is particularly applicable to hydraulic systems, such as fuel injection systems, used in internal combustion engines.

6 Claims, 2 Drawing Sheets

ELECTRONIC TRIM FOR A VARIABLE DELIVERY PUMP IN A HYDRAULIC SYSTEM FOR AN ENGINE

TECHNICAL FIELD

The present invention relates generally to variable delivery pumps in hydraulic systems for internal combustion engines, and more particularly to electronic trimming of variable delivery pumps in hydraulic systems.

BACKGROUND

Hydraulic systems, particularly those used in conjunction with an internal combustion engine, have been known for years. For example, Caterpillar Inc. of Peoria, Ill. has been successfully manufacturing and selling hydraulic fuel injection systems for many years. In the past, these systems typically included at least one common rail containing high pressure actuation fluid that was supplied to actuate a plurality of hydraulic devices, such as hydraulically actuated fuel injectors and/or gas exchange valve actuators (engine brake, intake, exhaust). The high pressure common rail was supplied with pressurized actuation fluid by a fixed displacement pump. Control of pressure in the common rail was maintained by sizing the pump to always supply more than the needed amount of high pressure fluid and then utilizing a rail pressure control valve to spill a portion of the fluid in the common rail back to the low pressure reservoir. The control system strategy for these systems typically relied upon a feedback control loop in which the desired rail pressure was compared to the measured or estimated rail pressure, and the position of the rail pressure control valve was set as a function of the error signal generated by that comparison. A system of this type is illustrated, for example, in U.S. Pat. No. 5,357,912 to Barnes et al. While these hydraulic systems, and the control thereof, have performed magnificently for many years, there remains room for improvement.

One area in which these previous hydraulic systems could be improved is by decreasing the amount of pressurized actuation fluid that is spilled back to the low pressure reservoir without performing any useful work, such as actuating one of the hydraulic devices. In other words, energy is consumed and arguably wasted whenever the rail pressure control valve opened to allow pressurized fluid from the high pressure rail to leak back to the low pressure reservoir. In order to decrease the amount of energy consumed in controlling the pressure in the hydraulic system, one strategy has been to introduce a variable delivery pump, and eliminate the previous rail pressure control valve. Such a hydraulic system is shown and described in co-owned U.S. Pat. No. 6,035,828 to Anderson et al. This system greatly reduces the amount of wasted energy since the pump is controlled to produce only the amount of actuation fluid necessary to maintain a desired rail pressure. Although this type of fluid supply and pressurization strategy has considerable promise, it still may suffer from at least one subtle drawback when it is controlled via a feedback loop based upon a comparison of the desired rail pressure to the actual rail pressure. Due at least in part to the fact that the fluid being consumed from the high pressure common rail can be rapidly and continuously changing, engineers have observed that the control system can be at least temporarily overwhelmed in this highly dynamic system. In other words, the system can sometimes demonstrate an inability to both maintain an adequate fluid supply to the hydraulic devices and do so at the desired pressure without unacceptable lags between the control system response and the fluid demands of the hydraulic devices.

Another potential problem area in controlling these hydraulic systems using a variable delivery pump lies in the inevitable fact that each pump has slightly different performance characteristics. These variations in performance can most often be attributed to the geometrical tolerance assigned to the various components that make up the pump. For instance, slight variations in the diametrical clearances between pump pistons and their respective barrels can produce a substantial and even measurable difference in performance from one pump to another. Since the control system often operates under the assumption that the pump is behaving with performance parameters equal to a hypothetical nominal pump, the timing and accuracy of maintaining a desired pressure in the common rail can sometimes be unacceptably large. In other words, the accuracy and timing of producing a desired rail pressure can suffer when the pump deviates in its performance from that of a nominal pump. One possible strategy for dealing with this problem would be to attempt to reduce tolerances in the various components to a level that resulted in pumps having relatively low variability. However, such a strategy may not be viable because of the likely large number of rejected pumps that would fall outside of the accepted variability range and/or potentially costly efforts to reduce component tolerances that would be required to produce pumps with low variability.

The present invention is directed to these and other problems associated with variable delivery pumps and hydraulic systems.

SUMMARY OF THE INVENTION

In one aspect, a method of preparing an electronically controlled variable delivery pump for tuning comprises an initial step of testing the pump at at least one operating condition. The results of the pump test are then recorded. Finally, information is provided for programming an electronic control module to adjust a pump control signal based upon the pump test result.

In another aspect, a method of tuning an electronically controlled variable delivery pump includes a step of reading data that is a function of the pump's performance characteristics into an electronic control module. Next, the electronic control module is programmed to generate pump control signals that are a function of the data. Finally, a control communication link is established between the pump and the electronic control module.

In still another aspect, a variable delivery pump includes a housing with an inlet and an outlet. An electronic controller is attached to the housing. Pump performance data is stored on a data storage device that is also attached to the pump housing.

DETAILED DESCRIPTION

Figure 1:
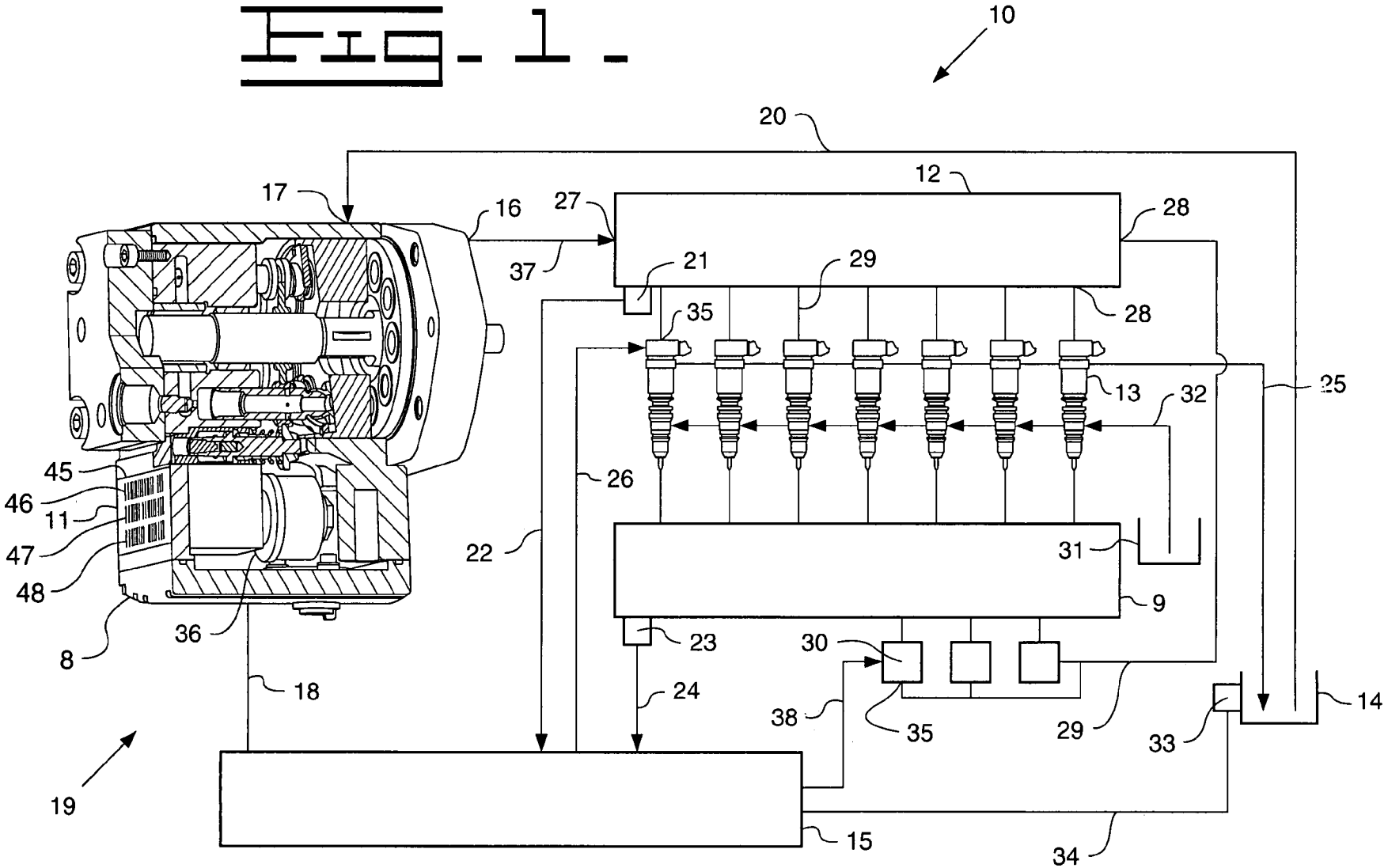
FIG. 1 is a schematic illustration of an engine and hydraulic system according to one aspect of the present invention.

Referring to FIG. 1, an internal combustion engine 9, which is preferably of the diesel type, includes a hydraulic system 10 that includes a pump 11, a high pressure common rail 12 and a plurality of hydraulic devices 13, 30. Pump 11 can be any suitable variable delivery pump, but is preferably a fixed displacement sleeve metered variable delivery axial piston pump of the type generally described in co-owned U.S. Pat. No. 6,035,828. Those skilled in the art recognize that these pumps are mechanically actuated, but the output is electronically controlled. Nevertheless, those skilled in the art will appreciate that any suitable variable delivery pump, such as a variable angle swash plate type pump whose output is controlled via an electrical signal, could be substituted for the illustrated pump without departing from the intended scope of the present invention. The hydraulic system 10 includes a plurality of hydraulic devices, which preferably include a plurality of fuel injectors 13, and might also include a plurality of gas exchange valve actuators 30, such as engine brake actuators, exhaust valve actuators and/or intake valve actuators.

Fuel injectors 13 are preferably hydraulically actuated fuel injectors of the type manufactured by Caterpillar Inc. of Peoria, Ill., but could be any suitable common rail type fuel injector, or possibly a Bosch type common rail fuel injector of the type described in "Heavy Duty Diesel Engines—The Potential of Injection Rate Shaping for Optimizing Emissions and Fuel Consumption", presented by Messrs Bernd Mahr, Manfred Dürnholz, Wilhelm Polach, and Hermann Grieshaber, Robert Bosch GmbH, Stuttgart, Germany at the 21st International Engine Symposium, May 4–5, 2000, Vienna, Austria. In the illustrated preferred embodiment, the hydraulic system 10 utilizes lubricating oil, but those skilled in the art will appreciate that any other fluid could be used, such as diesel fuel (Bosch), depending upon the nature and structure of the hydraulic devices.

In the preferred embodiment illustrated, variable delivery pump 11 has a housing 8 which includes an inlet 17 connected to a low pressure reservoir/oil pan via a low pressure supply line 20. An outlet 16 of variable delivery pump 11 is fluidly connected to an inlet 27 of high pressure common rail 12 via a high pressure supply line 37. Common rail 12 includes a plurality of outlets 28 that are fluidly connected to device inlets 35 via a plurality of high pressure supply lines 29. After being used by the respective hydraulic device (fuel injectors 13 and gas exchange valve actuators 30) the used oil returns to low pressure reservoir 14 via an oil return line 25 for recirculation. The system also includes, in this example embodiment, a fuel tank 31 that is fluidly connected to fuel injectors 13 via a fuel supply line, which is preferably at a relatively low pressure relative to that in high pressure common rail 12.

In order to control hydraulic system 10 and the operation of engine 9, an electronic control module 15 receives various sensor inputs, and uses those sensor inputs and other data to generate control signals, usually in the form of a control current level or control signal on-time, to control the various devices, including the variable delivery pump 11, fuel injectors 13 and gas exchange valve actuators 30. In particular, a pressure sensor 21 senses pressure somewhere in hydraulic system 10, preferably at high pressure common rail 12, and communicates a pressure signal to electronic control module 15 via a sensor communication line 22. Electronic control module then uses that sensor signal to estimate the pressure in common rail 12. A speed sensor 23, which is suitably located on engine 9, communicates a sensed speed signal to electronic control module 15 via a sensor communication line 24. The electronic control module 15 uses this signal to periodically update its estimate of the engine speed. A temperature sensor 33, which can be located at any suitable location in hydraulic system 10 but preferably in rail 12, communicates an oil temperature sensor signal to electronic control module 15 via a sensor communication line 34. Like the other sensors, electronic control module 15 uses the signal to estimate the oil temperature in hydraulic system 10. The electronic control module preferably combines the temperature estimate with other data, such as an estimate of the grade of the oil in hydraulic system 10, to generate a viscosity estimate for the oil. Those skilled in the art will appreciate that viscosity estimates can be gained by other means, such as by pressure drop sensors, viscosity sensors, etc. Electronic control module 15 controls the activity of fuel injectors 13 in a conventional manner via an electronic control signal communicated via injector control lines 26, only one of which is shown. Likewise, in a similar manner, gas exchange valve actuators 30 are controlled in their operation via an electronic current signal carried by control communication line(s) 38. In most instances, the ECM actually controls current levels, duration and timing.

Electronic control module 15 could also be considered a portion of a pump output controller 19 that includes an electro hydraulic actuator 36 and a control communication line 18. Preferably, electro hydraulic actuator 36 controls the output of variable delivery pump 11 in proportion to the electronic current supplied via control communication line 18 in a conventional manner. For instance, in the preferred embodiment, electro hydraulic actuator 36 moves sleeves surrounding pistons in pump 11 to cover spill ports to adjust the effective stroke of the pump pistons. The pump output controller 19 could be analog, but preferably includes a digital control strategy that updates all values in the system at a suitable rate, such as every so many milliseconds. The pump control signal generated by electronic control module 15 is preferably a function of the difference between the desired rail pressure and the estimated rail pressure, and the estimated consumption rate of the entire hydraulic system 10.

In order to accurately control fluid pressure in the common rail in this highly dynamic environment, and do so in a timely manner, it is important that the pump behave in a predictable manner to the control signals. In the past, the electronic control module assumed that the pump was behaving like a nominal pump, in that at some threshold control signal level the pump begins to produce output, and that output increases in a known manner in proportion to the magnitude of the control signal. Since it is nearly inevitable that the actual pump performance characteristics will deviate to at least some extent from the nominal performance characteristics, the present invention contemplates the production of pump control signals that take into account the individual pump's performance characteristics. Thus, it is important to the operation of the present invention that the actual performance characteristics of the individual pump be determined, and preferably a deviation between those measured characteristics and nominal pump characteristics be assessed.

Nominal pump performance characteristics can be determined in any suitable conventional manner such as by testing and modeling. The pump performance characteristics of the individual pumps are preferably determined through testing at at least one, and preferably several, operating conditions. By controlling the pump via control signals that are a function of the pump's individual characteristics, it is believed that rail pressure can be controlled more accurately and timely because the burden on the control system would be reduced. In other words, the control system can concentrate on removing any error between a sensed rail pressure and a desired rail pressure, instead of also having to compensate for deviations between actual pump performance and an expected or nominal pump performance. Although the present invention is preferably implemented by determining how the actual pump deviates from a nominal pump, the present invention could also be implemented in absolute terms without any reference to a so called nominal pump performance characteristic. Which strategy, or a combination of both, depends on the controller algorithm strategy.

Figure 2:
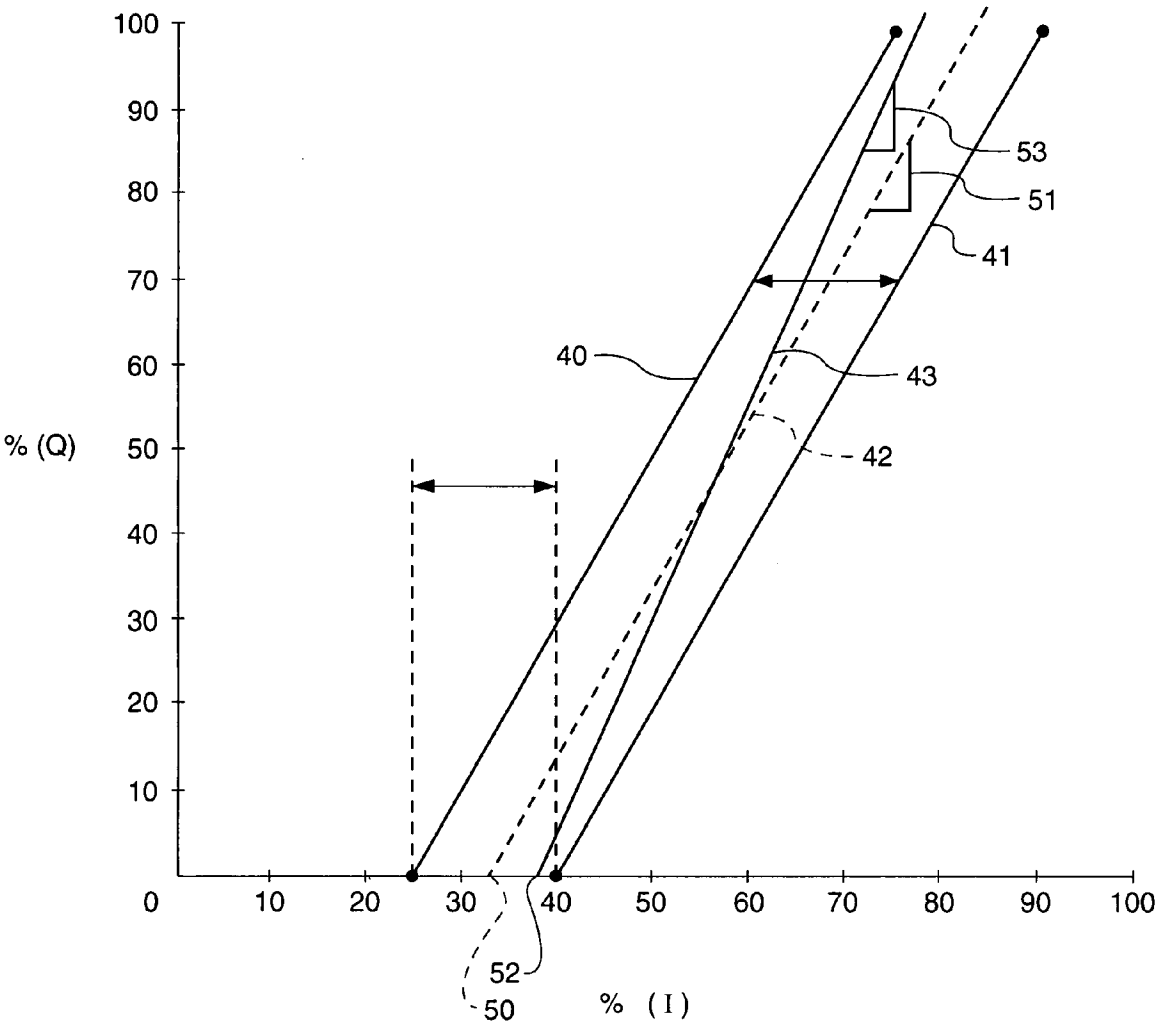
FIG. 2 are graphs of pump displacement percentage (Q) verses control signal magnitude (I) for a nominal pump, an example pump as well as expected lower and upper limits to pump variability.

Referring now to FIG. 2, a nominal pump performance curve 42 includes a nominal threshold control signal 50 and a nominal performance curve slope 51. Thus, when a nominal pump is supplied with a control signal magnitude (electric current) that is lower than nominal threshold control signal 50, it produces no output. By knowing the nominal threshold control signal 50 and the nominal performance curve slope 51, the percent displacement Q can be determined as a function of any current magnitude. The maximum nominal output or 100% Q corresponds to a certain control signal magnitude. Those skilled in the art will recognize that control signals that exceed that magnitude will have no effect. In other words, regardless of the control signal magnitude, the nominal pump cannot produce more output than its maximum rated output. Also shown in FIG. 2 are lower boundary curve 40 and upper boundary pump performance curve 41 that define the upper and lower variability for the actual performance characteristics of individual pumps. For instance, an actual pump performance curve 43 includes an actual threshold control signal 52 and an actual pump performance curve slope 53, which are both different from those of nominal pump performance curve 42. It should be noted that FIG. 2 is a graph of percent displacement Q rather than absolute displacement, which is a function of pump shaft rotation speed, which is generally in turn a function of engine speed. Thus, a third measurement that illustrates the difference between an actual pump performance characteristic and a nominal pump performance characteristic would be a comparison of absolute volume output at a given percent displacement to a nominal absolute volume output at a similar percentage displacement. This additional measure might be useful in model based rail pressure control systems in which absolute pump volume output is modeled and predicted at all times. Thus, curves 42 and 43 in FIG. 2 illustrate that this example actual pump requires a higher than nominal threshold control signal in order to cause the pump to produce any output, and the pump reaches its maximum output at a control signal substantially less than that of a nominal pump. By incorporating this knowledge into the control strategy, the control system can more quickly and more accurately control the pump output and hence the rail pressure for the entire hydraulic system.

Referring back in addition to FIG. 1, each pump is preferably tested by first gradually raising the control signal magnitude until it first begins producing output. This number corresponds to the actual threshold control signal 52. The control signal level then can be continuously increased until the pump reaches its maximum output. Assuming a linear relationship between pump output and control signal magnitude, those two measurements should be sufficient to calculate both the actual threshold control signal 52 and the actual pump performance curve slope 53. Those skilled in the art will recognize that the present invention is not limited to pumps that exhibit a linear relationship between output and control signal magnitude. The two performance characteristics 52 and 53 are then recorded. Preferably, these pump characteristics are recorded on a suitable data storage device 45 that is associated with that individual pump by being preferably attached to the pump housing 8. For instance, the data storage device 45 may be a simple sticker upon which the actual threshold control signal 52 is encoded as a first barcode 46 on data storage device 45. The slope of the pump performance curve is preferably stored on data storage device 45 as a second barcode 47. A third number indicative of a deviation between the actual and nominal pump absolute volume output might be encoded as a third barcode 48 on data storage device 45. In the preferred embodiment, data storage device might be a simple sticker that is attached to the outer surface of the pump. Other data storage devices could be used, including but not limited to magnetic strips or other machine readable formats. When the pump is actually installed on an engine, the barcodes can be read in any suitable manner, such as by using an optical barcode scanner in the case of the example illustration. Those numerical values can then be used to program the electronic control module to adjust pump control signals in a way that takes into account the individual pump performance characteristics. In addition, if desirable, the absolute volume characteristics of the pump may also be utilized, especially in those cases where the control system uses a pump model, and can be read and programmed into the ECM in a similar manner. Finally, the installation is completed by establishing a control communication link between the electronic control module and the electro hydraulic actuator 36 for the pump output controller.

INDUSTRIAL APPLICABILITY

The present invention finds potential application in any hydraulic system, but is particularly applicable to hydraulic systems that include a common rail fuel injection system. When in operation, the pump output controller 19, which includes electronic controller module 15, preferably operates in a conventional digital manner at some suitable execution rate, such as every so many milliseconds or at some event rate such as firing rate. Thus, every so many milliseconds, electronic control module 15 updates its estimates of the rail pressure, the liquid temperature and the engine speed, which corresponds to the pump shaft rotation rate. In addition, other aspects of the electronic control module are utilizing other sensor inputs and user commands to determine the amount of fuel that is desired to be injected during a subsequent engine cycle. This desired amount of fuel and the operating condition of the engine generally determine what the desired rail pressure should be. Thus, the desired rail pressure is also preferably being updated during each computation cycle. Those skilled in the art will appreciate that not all aspects of the system need updating every computation cycle. Different parts of the model(s) can operate at different rates depending on the response of the system. The control system preferably combines the estimated system consumption rate with the control rate to arrive at a requested flow rate for the pump that is preferably calculated as a pump percentage displacement similar to that graphed in FIG. 2. This requested percentage displacement is then truncated in the event that it exceeds the maximum possible output rate for the pump. This requested pump percentage displacement is then converted into a pump control current that is used to adjust the position of the electro hydraulic controller 36 to make variable delivery pump 11 produce an output displacement percentage corresponding to the requested pump displacement percentage. Before being sent to the pump, the pump control signal is adjusted so that the control signal corresponds to the displacement percentage requested for that actual pump rather than for a nominal pump.

Those skilled in the art will recognize that, depending upon the characteristics of the individual hydraulic system, the structure of the pump and how it is controlled as well as the overall control system strategy, an implementation of the present invention into other hydraulic systems could look substantially different. For instance, the pump might be biased to produce its maximum output when no control signal is present, rather than no output as in the example illustrated pump. Furthermore, the relationship between control signal magnitude and pump output may not be linear. In addition, the sophistication level of the present invention could go well beyond that illustrated in the example embodiment. For instance, it might be desirable to determine how individual pumps deviate in performance from a nominal pump as a function of other variables, such as fluid viscosity, temperature, speed, ambient pressure, etc. Depending on the performance demands of the individual hydraulic system, the level of sophistication in applying the concepts of the present invention can be adjusted in complexity to meet the specific demands of each individual system.

Those skilled in the art will recognize that the present invention provides the ability to control system pressure in a more accurate and timely manner. It is believed that a consequence of such control should be more accurate control over injection performance, likely resulting in a lowering of undesirable engine emissions while improving overall engine performance. The present invention also has the ability to reduce costs by allowing pumps with a wider range of variability to be acceptable for use in hydraulic systems. The reason being that, although the individual pump may vary substantially from the performance of a nominal pump, one can accommodate for this deviation by appropriate trimming of control signals generated by the electronic control module. Thus, the present invention has the ability to not only improve performance but also reduce costs by reducing the number of pumps that need to be scrapped or reworked in order to become acceptable. Furthermore, the present invention also has the potential ability to further reduce costs by allowing the individual geometrical tolerances for pump components to be relaxed.

When in operation, the electronic control module senses rail pressure and determines a correction is needed. It then commands a change of control current to the pump, waits during the sampling period, checks the pressure again and changes current to the pump again if necessary. This sampling and waiting mode of pressure correction continues until the pressure in a rail matches the desired pressure. Each displacement control pump generally has three distinct performance characteristics: 1. a threshold or minimum current to begin displacement changes (also known as a starting or minimum) current, the gain slope (displacement verses current percent Q/I, see FIG. 2), and ending or maximum current. The current range or the range over which control is possible is the ending current minus the starting current. Any current inputs outside of these two points or outside of this range have no impact upon the action of the pump. Therefore, any time the electronic control module makes current inputs beyond this range, it wastes or misuses that particular sampling period. That misuse of time can cause higher emissions and reduce engine performance. Only when the ECM commands inputs inside of the control range is the sampling period being used efficiently.

As stated above, each pump is different than the rest, having in the example embodiment, three unique performance characteristics. Because of this, the ECM may know the effective current range for a nominal pump, but unless the present invention is implemented, the ECM does not know the effective current range for the individual pump in its hydraulic system. The present invention has the potential to eliminate the need for the ECM to go beyond the actual current range of the pump via use of the programmed ECM software. The three number code can be stamped on the pump like a barcode or other suitable code and then scanned into the engine software. Each numeral can be used to describe one of the three performance characteristics. The software can then use the code to determine the actual operating characteristics of the pump. With these operating characteristics, the ECM modifies the appropriate software parameters to achieve improved hydraulic system performance, which will result in a reduction in undesirable emissions and an improvement to engine performance.

In addition to the electronic trimming strategy described above with regard to the example hydraulic system, other potential pump characteristics can also be encoded and scanned into the engine control module to further increase the speed and accuracy of the hydraulic system control. For instance, the ratio of actual pump performance to nominal pump performance or volumetric efficiency could be determined as a function of fluid pressure, as a function of oil temperature/viscosity, as a function of percentage displacement of the pump, as a function of differing pump inlet pressures, which correspond to the engine lubricating oil pressure, and possibly even as function of the oil bulk modulus. As discussed above, one new engine control strategy called a model based control attempts to calculate the oil usage of the hydraulically actuated fuel injectors and/or engine brakes, and 2) calculate the required current to the pump to provide that oil flow based upon engine speed, pump outlet pressure, oil viscosity (or oil temperature) oil bulk modulus, geometric displacement of the pump, and lube oil pressure. Based upon these perameters, the engine control would likely initially default to the calculated nominal current, and then make minor adjustments to maintain or control rail pressure using a conventional feedback control strategy. An extra code that could be stamped on the pump is the percent flow at a given speed when compared to a nominal pump. For instance, a nominal pump may produce 40 LPM at 3000 RPM. As a pump has completed the assembly and test sequence, the flow at 3000 RPM may be 41.2 LPM. This pump would be considered 103% of nominal. This code could be stamped or otherwise attached to the housing for the pump and then scanned into the engine control module, thereby increasing the accuracy of the flow calculations and subsequent current predictions.

Those skilled in the art will appreciate that the present invention has been described in the example context of a Caterpillar Inc. type hydraulic fuel injection system. The present invention is also applicable to other types of common rail systems, such as the Bosch APCRS fuel system identified in "Heavy Duty Diesel Engines—The Potential of Injection Rate Shaping for Optimizing Emissions and Fuel Consumption", presented by Messrs. Bernd Mahr, Manfred Durnholz, Wilhelm Polach, and Hermann Grieshaber, Robert Bosch GmbH, Stuttgart, Germany, at the 21$^{st}$ International Engine Symposium, May 4–5, 2000, Vienna, Austria.

Those skilled in the art will appreciate that various modifications could be made to the illustrated embodiment without departing from the intended scope of the present invention. For instance, the present invention can also be used in other hydraulic applications outside the realm of hydraulic fuel injection systems. Applications requiring speed control (such as a machine with a hydrostatic transmission or a hydraulic cylinder on an injection molding machine) and torque or horsepower controlled machines (limiting the pressure and volume of discharge to prevent the pump from using more power than the prime mover can provide, could benefit from an implementation of the present invention to their control strategy. For instance, performance and/or gain curves (current verses power/actual discharge flow/torque) can be plotted and encoded into the engine electronic control module or other electronic device. Thus, other aspects, objects and advantages of this invention can be obtained from a study of the drawings, the disclosure and the appended claims.

What is claimed is:

1. A method of preparing a mechanically actuated electronically controlled variable delivery fuel injector supply pump for tuning before installation in a hydraulic system, comprising the steps of:

testing at least one pump operating condition at least in part by mechanically powering the pump while supplying a pump output controller with a predetermined electronic control signal;

recording at least one pump test result at least in part by measuring an output from the pump;

providing information based on the pump test result to an electronic control module operably coupled to the pump; and said testing step includes a step of determining a threshold control signal at which the pump begins to produce output.

2. A method of preparing an electronically controlled variable delivery fuel injector supply pump for tuning before installation in a hydraulic system, comprising the steps of:

testing at least one pump operating condition;

recording at least one pump test result;

providing information based on the pump test result to an electronic control module operably coupled to the pump, wherein the information includes first data that is a function of a threshold control signal at which the pump begins to produces output, second data that is a function of a curve slope relating control signal magnitude to pump output magnitude, and third data that is a function of a maximum control signal beyond which the pump produces no additional output.

3. A method of installing an electronically controlled variable delivery fuel injector supply pump in a hydraulic system, comprising the steps of:

fluidly connecting an inlet and an outlet of the pump to a hydraulic system upstream from a common rail;

mechanically coupling the pump to an engine;

reading test data that is a function of the pump's performance characteristics from a data storage device associated with the pump;

programming an electronic control module to generate pump control signals that are a function of the test data;

establishing a control communication link between the pump and the electronic control module; and the programming step includes a step of setting a threshold control signal at which the pump begins to produce output.

4. The method of claim 1 wherein said providing step includes a step of attaching coded information in a machine readable format to a pump housing of the pump.

5. The method of claim 2 wherein said providing step includes a step of attaching coded information in a machine readable format to a pump housing of the pump.

6. The method of claim 3 wherein the reading step includes a step of scanning coded information from a code attached to a pump housing of the pump.

* * * * *